US012692858B2

(12) United States Patent
Hiwata et al.

(10) Patent No.: US 12,692,858 B2
(45) Date of Patent: Jul. 28, 2026

(54) REFRIGERATION CYCLE DEVICE

(71) Applicant: Panasonic Intellectual Property Management Co., Ltd., Kadoma (JP)

(72) Inventors: Akira Hiwata, Shiga (JP); Yoshiaki Doyama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 18/860,395

(22) PCT Filed: Apr. 18, 2023

(86) PCT No.: PCT/JP2023/015489
§ 371 (c)(1),
(2) Date: Oct. 25, 2024

(87) PCT Pub. No.: WO2023/210444
PCT Pub. Date: Nov. 2, 2023

(65) Prior Publication Data

US 2025/0290502 A1 Sep. 18, 2025

(30) Foreign Application Priority Data

Apr. 28, 2022 (JP) ..... 2022-075303

(51) Int. Cl.
*F04B 49/06* (2006.01)
*F04B 35/04* (2006.01)
(Continued)

(52) U.S. Cl.
CPC ..... *F04B 49/06* (2013.01); *F04B 35/04* (2013.01); *F25B 31/02* (2013.01); *F25B 49/022* (2013.01); *F04B 2203/0202* (2013.01)

(58) Field of Classification Search
CPC .. F04B 49/06; F04B 35/04; F04B 2203/0202; F04B 39/00; F25B 31/02; F25B 49/022; F25B 49/025; F25B 1/00
See application file for complete search history.

(56) References Cited

U.S. PATENT DOCUMENTS

2013/0269370 A1 10/2013 Hatakeyama et al.
2014/0070132 A1 3/2014 Fukushima
(Continued)

FOREIGN PATENT DOCUMENTS

EP 3764027 A1 1/2021
JP 2017-003197 A 1/2017
(Continued)

OTHER PUBLICATIONS

International Search Report, International Patent Application No. PCT/JP2023/015489, Jul. 11, 2023, with English translation (5 pages).
(Continued)

*Primary Examiner* — Loren C Edwards
(74) *Attorney, Agent, or Firm* — HSML P.C.

(57) ABSTRACT

The refrigerator cycle device includes a control device controlling a compressor including a sealed container constituting a fluidic pathway for a working medium containing ethylene-based fluoroolefin as a refrigerant component, and a compression mechanism and an electric motor inside the sealed container. The control device includes a drive circuit and a control circuit. The drive circuit includes a converter circuit including a first output point outputting a first voltage, a second output point outputting a second voltage lower than the first voltage, and a third output point outputting a third voltage between the first voltage and the second voltage; and an inverter circuit including first to third semiconductor switching element groups connected between the first to third output points and the electric motor.
(Continued)

The control circuit performs PWM control on the first to third semiconductor switching element groups to allow the drive circuit to operate the electric motor.

16 Claims, 7 Drawing Sheets

(51) Int. Cl.
*F25B 31/02* (2006.01)
*F25B 49/02* (2006.01)

(56) References Cited

U.S. PATENT DOCUMENTS

| | | | | |
|---|---|---|---|---|
| 2014/0077123 | A1 | 3/2014 | Fukushima | |
| 2018/0156217 | A1* | 6/2018 | Sakima | F04C 29/00 |
| 2023/0203357 | A1 | 6/2023 | Watanabe et al. | |

FOREIGN PATENT DOCUMENTS

| | | | | | |
|---|---|---|---|---|---|
| JP | 2020070930 | A | * | 5/2020 | |
| JP | 2021161316 | A | * | 10/2021 | C09K 5/045 |
| JP | 2022-044019 | A | | 3/2022 | |
| WO | 2012/157764 | A1 | | 11/2012 | |
| WO | 2012/157765 | A1 | | 11/2012 | |

OTHER PUBLICATIONS

English translation of the international preliminary report on patentability issued in PCT International Patent Application No. PCT/JP2023/015489, Nov. 7, 2024 (5 pages).
Extended European Search Report, European Patent Application No. 23796187.5, Jun. 27, 2025 (9 pages).

* cited by examiner

1

REFRIGERATION CYCLE DEVICE

TECHNICAL FIELD

The present disclosure relates to a refrigeration cycle device.

BACKGROUND ART

Conventionally, R410A has been widely used as a working medium (heat medium, refrigerant) for refrigeration cycle devices. However, the global warming potential (GWP) of R410A is as high as 2090. Therefore, from the viewpoint of preventing global warming, research and development of working media with smaller GWPs has been conducted. Patent Document 1 discloses 1,1,2-trifluoroethylene (HFO1123) as a working medium with a smaller GWP than R410A. Patent Document 2 discloses 1,2-difluoroethylene (HFO1132) as a working medium with a smaller GWP than R410A.

PRIOR ART DOCUMENTS

Patent Documents

Patent Document 1: WO 2012/157764 A1
Patent Document 2: WO 2012/157765 A1

SUMMARY OF THE INVENTION

Problems to be Solved by the Invention

In particular, HFO1123 and HFO1132 have a smaller GWP than R410A, but are therefore less stable than R410A. For example, the generation of radicals may cause a disproportionation reaction of HFO1123 or HFO1132, resulting in the conversion of HFO1123 and HFO1132 to other compounds.

The present disclosure provides a refrigeration cycle device enabling suppression of a disproportionation reaction of a working medium.

Solutions to the Problems

A refrigeration cycle device according to one aspect of the present disclosure includes: a refrigeration cycle circuit including a compressor, a condenser, an expansion valve and an evaporator, and allowing circulation of a working medium; and a control device configured to control the compressor of the refrigeration cycle circuit. The working medium contains ethylene-based fluoroolefin as a refrigerant component. The compressor includes: a sealed container constituting a fluidic pathway for the working medium; a compression mechanism positioned inside the sealed container to compress the working medium; and an electric motor positioned inside the sealed container to operate the compression mechanism. The control device includes: a drive circuit configured to drive the electric motor; and a control circuit configured to control the drive circuit. The drive circuit includes: a converter circuit including a plurality of output points including a first output point for outputting a first voltage, a second output point for outputting a second voltage lower than the first voltage, and one or more third output points for outputting a third voltage between the first voltage and the second voltage; and an inverter circuit including a plurality of semiconductor switching element groups including a first semiconductor switching element group connected between the first output point and the electric motor, a second semiconductor switching element group connected between the second output point and the electric motor, and one or more third semiconductor switching element groups individually connected between the one or more third output points and the electric motor. The control circuit is configured to perform PWM control on the plurality of semiconductor switching element groups of the inverter circuit of the drive circuit to allow the drive circuit to operate the electric motor.

A refrigeration cycle device according to one aspect of the present disclosure includes: a refrigeration cycle circuit including a compressor, a condenser, an expansion valve and an evaporator, and allowing circulation of a working medium: and a control device configured to control the compressor of the refrigeration cycle circuit. The working medium contains ethylene-based fluoroolefin as a refrigerant component. The compressor includes: a sealed container constituting a fluidic pathway for the working medium; a compression mechanism positioned inside the sealed container to compress the working medium; and an electric motor positioned inside the sealed container to operate the compression mechanism. The control device includes: a multi-level inverter configured to drive the electric motor; and a control circuit configured to perform PWM control on the multi-level inverter.

Effects of the Invention

The present aspect enables suppression of a disproportionation reaction of a working medium.

DETAILED DESCRIPTION

1. Embodiments

Figure 1:
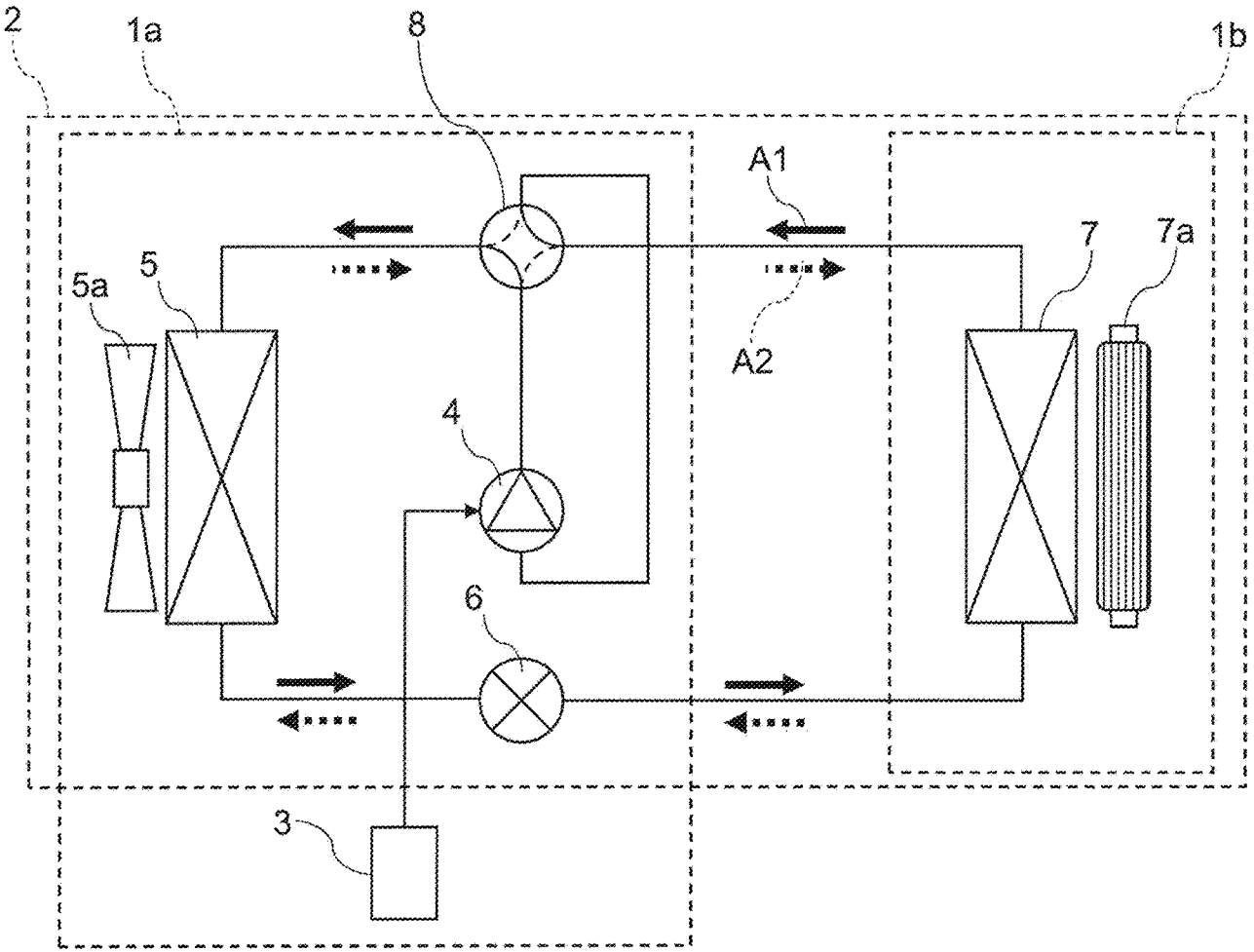
FIG. 1 is a block diagram of a configuration example of a refrigeration cycle device in accordance with one embodiment.

Hereinafter, embodiments of the present disclosure will be described with reference to the drawings where appropriate. However, the following embodiments are merely examples for explaining the present disclosure, and are not intended to limit the present disclosure to the following content. Positional relationships such as up, down, left, and right are based on the positional relationships shown in the drawings, unless otherwise specified. Each figure described in the following embodiments is a schematic diagram, and the ratios of size and thickness of each component in each figure do not necessarily reflect the actual dimensional ratios. Furthermore, the dimensional ratios of each element are not limited to the ratios shown in the drawings.

Note that, in the following description, if it is necessary to distinguish a plurality of components from each other, prefixes, such as, "first", "second", or the like are attached to names of such components. However, if these components can be distinguished from each other by reference signs attached to those components, such prefixes, such as, "first", "second", or the like, may be omitted in consideration of readability of texts.

[1.1 Configurations]

FIG. 1 is a block diagram of a configuration example of a refrigerator cycle device 1 in accordance with the present embodiment. The refrigerator cycle device 1 of FIG. 1 constitutes an air conditioner enabling a cooling operation and a heating operation, for example.

The refrigerator cycle device 1 of FIG. 1 includes a refrigerator cycle circuit 2 and a control device 3.

The refrigerator cycle circuit 2 constitutes a fluidic pathway where the working medium circulates. In the present embodiment, the working medium contains ethylene-based fluoroolefin as a refrigerant component. The ethylene-based fluoroolefin may be ethylene-based fluoroolefin likely to undergo a disproportionation reaction. Examples of the ethylene-based fluoroolefin likely to undergo a disproportionation reaction may include 1,1,2-trifluoroethylene (HFO1124), trans-1,2-difluoroethylene (HFO1132 (E)), cis-1,2-difluoroethylene (HFO-1132 (Z)), 1,1-difluoroethylene (HFO-1132a), tetrafluoroethylene ($CF_2{=}CF_2$, FO1114), or monofluoroethylene (HFO-1141).

The working medium may include a plurality of types of refrigerant components. The working medium may contain ethylene-based fluoroolefin as a main refrigerant component, and additionally contain one or more chemical compounds other than ethylene-based fluoroolefin as one or more auxiliary refrigerant components. Examples of the auxiliary refrigerant components may include hydrofluorocarbons (HFC), hydrofluoroolefins (HFO), saturated hydrocarbons, and carbon dioxide. Examples of hydrofluorocarbons (HFC) may include difluoromethane, difluoroethane, trifluoroethane, tetrafluoroethane, pentafluoroethane, pentafluoropropane, hexafluoropropane, heptafluoropropane, pentafluorobutane, and heptafluorocyclopentane. Examples of hydrofluoroolefins (HFO) may include monofluoropropene, trifluoropropene, tetrafluoropropene, pentafluoropropene, and hexafluorobutene. Examples of saturated hydrocarbons may include ethane, n-propane, cyclopropane, n-butane, cyclobutane, isobutane (2-methylpropane), methylcyclopropane, n-pentane, isopentane (2-methylbutane), neopentane (2,2-dimethylpropane), and methylcyclobutane.

The working medium may further contain a disproportionation inhibitor for suppressing a disproportionation reaction of the ethylene-based fluoroolefin. Examples of the disproportionation inhibitor may include a saturated hydrocarbon or a haloalkane. Examples of saturated hydrocarbons may include ethane, n-propane, cyclopropane, n-butane, cyclobutane, isobutane (2-methylpropane), methylcyclopropane, n-pentane, isopentane (2-methylbutane), neopentane (2,2-dimethylpropane), and methylcyclobutane. In the above examples, n-propane is preferred. Examples of haloalkanes may include haloalkanes having one or two carbon atoms. Examples of haloalkanes having one carbon atom (i.e., halomethanes) may include (mono) iodomethane ($CH_3I$), diiodomethane ($CH_2I_2$), dibromomethane ($CH_2Br_2$), bromomethane ($CH_3Br$), dichloromethane ($CH_2Cl_2$), chloroiodomethane ($CH_2ClI$), dibromochloromethane ($CHBr_2Cl$), tetraiodomethane ($CI_4$), carbon tetrabromide ($CBr_4$), bromotrichloromethane ($CBrCl_3$), dibromodichloromethane ($CBr_2Cl_2$), tribromofluoromethane ($CBr_3F$), fluorodiiodomethane ($CHFI_2$), difluorodiiodomethane ($CF_2I_2$), and dibromodifluoromethane ($CBr_2F_2$), trifluoroiodomethane ($CF_3I$), and difluoroiodomethane ($CHF_2I$). Examples of haloalkanes with two carbon atoms (i.e. haloethanes) may include 1,1,1-trifluoro-2-iodoethane ($CF_3CH_2I$), monoiodoethane ($CH_3CH_2I$), monobromoethane ($CH_3CH_2Br$), and 1,1,1-triiodoethane ($CH_3CI_3$). The working medium may contain one or more types of haloalkanes having 1 or 2 carbon atoms. In other words, the haloalkanes having 1 or 2 carbon atoms may be used alone or in combination of two or more types.

The refrigerator cycle circuit 2 of FIG. 1 includes a compressor 4, a first heat exchanger 5, an expansion valve 6, a second heat exchanger 7, and a four-way valve 8.

The refrigerator cycle device 1 of FIG. 1 includes an outdoor unit 1*a* and an indoor unit 1*b*. The outdoor unit 1*a* includes the control device 3, the compressor 4, the first heat exchanger 5, the expansion valve 6, and the four-way valve 8. The outdoor unit 1*a* further includes a first air blower 5*a* for facilitating heat exchange at the first heat exchanger 5. The indoor unit 1*b* includes the second heat exchanger 7. The indoor unit 1*b* further includes a second air blower 7*a* for facilitating heat exchange at the second heat exchanger 7.

In the refrigerator cycle circuit 2 of FIG. 1, the compressor 4 compresses the working medium to increase a pressure of the working medium. The compressor 4 would be described in detail later. The first heat exchanger 5 and the second heat exchanger 7 enable heat exchange between the working medium circulating in the refrigerator cycle circuit 2 and external air (e.g., the outdoor air or the indoor air). The expansion valve 6 regulates the pressure (evaporation pressure) of the working medium and regulates a flow volume of the working medium. The four-way valve 8 switches a direction of the working medium circulating in the refrigerator cycle circuit 2 between a first direction corresponding to the cooling operation and a second direction corresponding to the heating operation.

In the present embodiment, as shown by a solid arrow A1 in FIG. 1, the first direction is a direction in which the working medium circulates in the refrigerator cycle circuit 2 in the order of the compressor 4, the first heat exchanger 5, the expansion valve 6, and the second heat exchanger 7.

In the cooling operation, the compressor 4 compresses and discharges the gaseous working medium, and thus the gaseous working medium is sent to the first heat exchanger 5 through the four-way valve 8. The first heat exchanger 5 conducts heat exchange between the outdoor air and the gaseous working medium and then the gaseous working medium is condensed to be liquefied. The liquid working medium is decompressed by the expansion valve 6 and is sent to the second heat exchanger 7. The second heat exchanger 7 conducts heat exchange between the liquid working medium and the indoor air, and then the gaseous working medium evaporates to become the gaseous working medium. The gaseous working medium returns to the compressor 4 through the four-way valve 8. In the cooling operation, the first heat exchanger 5 functions as a condenser, and the second heat exchanger 7 functions as an evaporator. Thus, the indoor unit 1*b* sends air cooled via heat exchange at the second heat exchanger 7 to an interior during cooling.

In the present embodiment, as shown by a broken arrow A2 in FIG. 1, the second direction is a direction in which the working medium circulates in the refrigerator cycle circuit 2 in the order of the compressor 4, the second heat exchanger 7, the expansion valve 6, and the first heat exchanger 5.

In the heating operation, the compressor 4 compresses and discharges the gaseous working medium, and thus the gaseous working medium is sent to the second heat exchanger 7 through the four-way valve 8. The second heat exchanger 7 conducts heat exchange between the indoor air and the gaseous working medium and then the gaseous working medium is condensed to be liquefied. The liquid working medium is decompressed by the expansion valve 6 and is sent to the first heat exchanger 5. The first heat exchanger 5 conducts heat exchange between the liquid working medium and the outdoor air, and then the gaseous working medium evaporates to become the gaseous working medium. The gaseous working medium returns to the compressor 4 through the four-way valve 8. In the heating operation, the second heat exchanger 7 functions as a condenser, and the first heat exchanger 5 functions as an evaporator. Thus, the indoor unit 1*b* sends air warmed via heat exchange at the second heat exchanger 7 to an interior during the heating.

Figure 2:
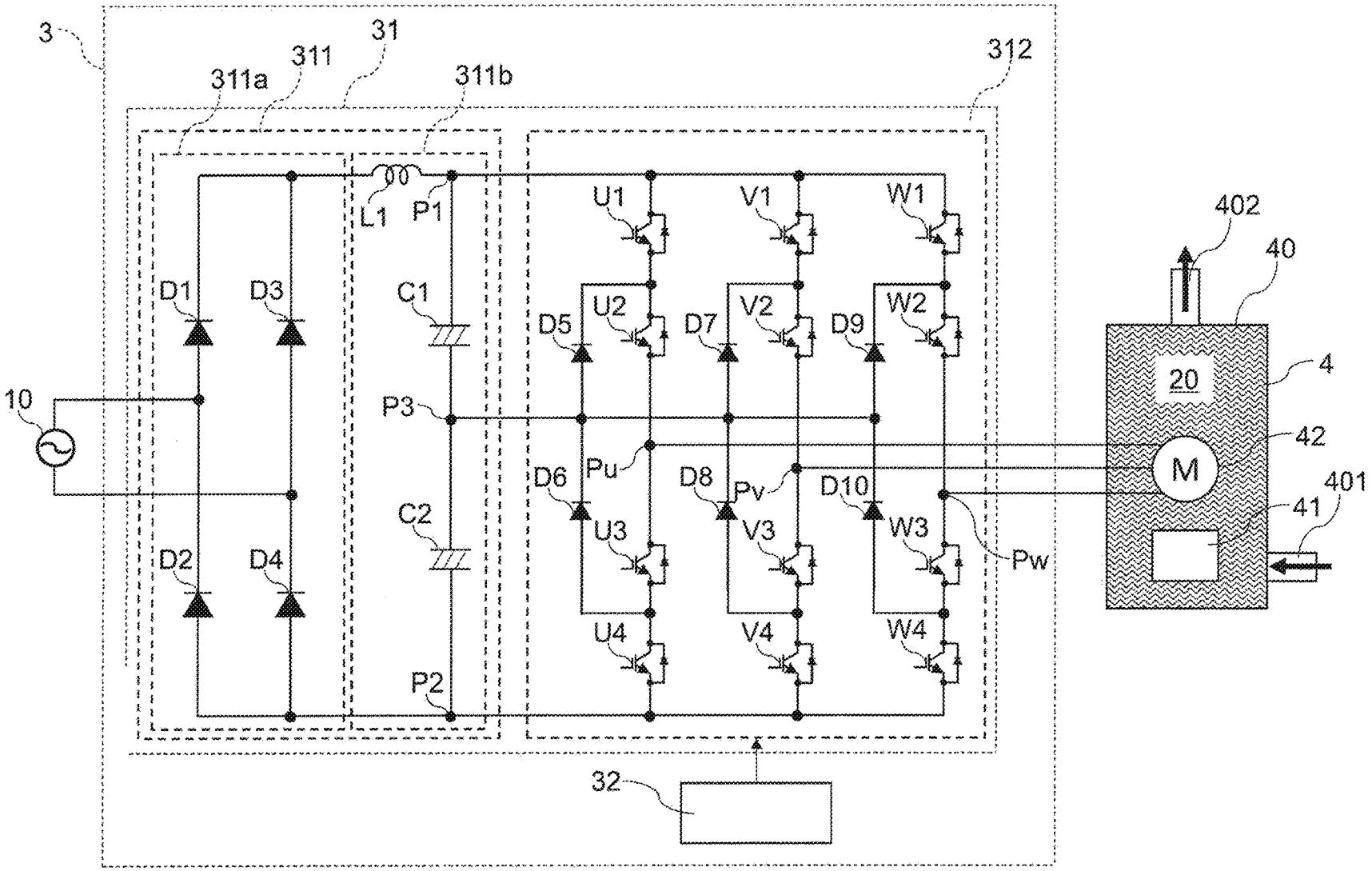
FIG. 2 is a schematic diagram of configuration examples of a compressor and a control device of the refrigeration cycle device of FIG. 1.

The control device 3 of FIG. 1 controls the refrigerator cycle circuit 2. FIG. 2 is a schematic diagram of configuration examples of the compressor 4 and the control device 3.

The compressor 4 is, for example, a hermetically sealed compressor. The compressor 4 may be of a rotary type, a scroll type, or other well-known type. The compressor 4 of FIG. 2 includes a sealed container 40, a compression mechanism 41, and an electric motor 42.

The sealed container 40 constitutes a fluidic pathway for the working medium 20. The sealed container 40 includes a suction pipe 401 and a discharge pipe 402. The working medium 20 is suctioned into the sealed container 40 via the suction pipe 401 and then is compressed by the compression mechanism 41 and thereafter is discharged to an exterior of the sealed container 40 via the discharge pipe 402. The inside of the sealed container 40 is filled with the working medium 20 with a high temperature and a high pressure together with a lubricating oil. The sealed container 40 has a bottom part which constitutes an oil reservoir for storing a mixed liquid of the working medium 20 and the lubricating oil.

The compression mechanism 41 is positioned inside the sealed container 40 to compress the working medium. The compression mechanism 41 may have a conventional configuration. For example, the compression mechanism 41 may include a cylinder forming a compression chamber, a rolling piston disposed in the compression chamber inside the cylinder, and a crank shaft coupled to the rolling piston.

Figure 3:
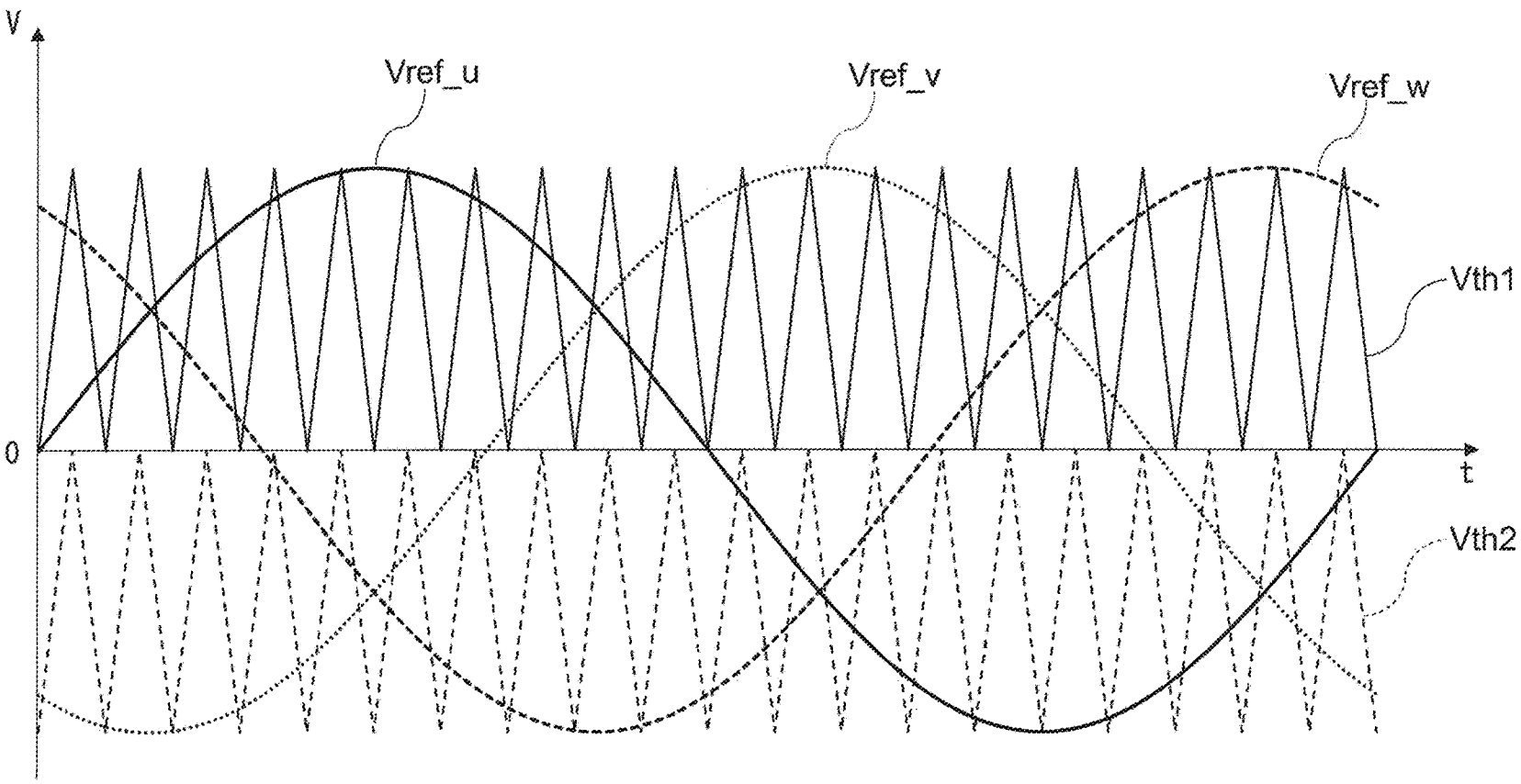
FIG. 3 is a waveform chart of one example of control operation of a drive circuit by a control circuit of the control device of FIG. 2.

The electric motor 42 is positioned inside the sealed container 40 to operate the compression mechanism 41. The electric motor 42 is a three-phase blushless motor. FIG. 3 is a schematic diagram of configuration examples of the electric motor 42 and the control device 3. The electric motor 42 includes a rotator fixed to the crank shaft of the compression mechanism 41 and a stator provided in a vicinity of the rotator, for example. The stator is configured by concentrated or distributed winding of stator windings (magnet wires) around a stator core (electrical or magnetic steel sheet or the like) with an insulation paper in-between. The stator windings are covered with insulating material. Examples of the insulating material may include polyethylene terephthalate (PET), polyethylene naphthalate (PEN), aramid polymer, and polyphenylene sulfide (PPS).

The compressor 4 may include an accumulator for preventing liquid compression in the compression chamber of the compression mechanism 41. The accumulator separates the working medium 20 into the gaseous working medium and the liquid working medium and directs only the gaseous working medium to the sealed container 40 via the suction pipe 401.

The control device 3 of FIG. 2 includes a drive circuit 31 and a control circuit 32.

The drive circuit 31 is configured to drive the electric motor 42. The drive circuit 31 of FIG. 2 is configured to supply drive power to the electric motor 42 based on power from a power supply 10. In the present embodiment, the power supply 10 is an alternating current power supply. The drive circuit 31 is configured to supply drive power to the electric motor 42 based on alternating current power from the power supply 10. Especially, the drive circuit 31 supplies three-phase alternating current power to the electric motor 42, as the drive power. The drive circuit 31 includes a converter circuit 311 and an inverter circuit 312.

The converter circuit 311 is configured to convert alternating current power from the power supply 10 into direct current power. The converter circuit 311 includes a rectification circuit 311*a* and a smoothing circuit 311*b*.

The rectification circuit 311*a* is a diode bridge constituted by a plurality of diodes D1 to D4. The power supply 10 is connected between input terminals (a connecting point between the diodes D1, D2 and a connecting point between the diodes D3, D4) of the rectification circuit 311*a* and the smoothing circuit 311*b* is connected between output terminals (a connecting point between the diodes D1, D3 and a connecting point between the diodes D2, D4) of the rectification circuit 311*a*. In FIG. 2, the power supply 10 is an alternating current power supply.

The smoothing circuit 311*b* is configured to smooth a voltage between the output terminals of the rectification circuit 311*a* to output it. The smoothing circuit 311*b* includes a series circuit of an inductor L1 and smoothing capacitors C1 and C2. In the smoothing circuit 311*b*, a connecting point between the inductor L1 and the smoothing capacitor C1 defines a first output point P1 for outputting a first voltage. In the smoothing circuit 311*b*, a connecting point between the connecting point between the diodes D2 and D4 and the smoothing capacitor C2 defines a second output point P2 for outputting a second voltage lower than the first voltage. In the smoothing circuit 311*b*, a connecting point between the smoothing capacitor C1 and the smoothing capacitor C2 defines a third output point P3 for outputting a third voltage between the first voltage and the second voltage. In a relationship among the first output point P1, the second output point P2 and the third output point P3, the first output point P1 is a high voltage point, the second output point P2 is a low voltage point, and the third output point P3 is a middle voltage point. In the smoothing circuit 311*b*, the smoothing capacitor C1 and the smoothing capacitor C2 have the same electrostatic capacitance. Therefore, a voltage between the first voltage and the third voltage is equal to a voltage between the second voltage and the third voltage.

The inverter circuit 312 is configured to supply alternating current power to the electric motor 42 based on the direct current power from the converter circuit 311. Especially, the inverter circuit 312 of FIG. 2 supplies three-phase alternating current power to the electric motor 42. The inverter circuit 312 includes a plurality of semiconductor switching elements U1 to U4, V1 to V4, W1 to W4. The semiconductor switching elements U1 to U4, V1 to V4, W1 to W4 are transistors or the like, for example.

The semiconductor switching elements U1 to U4 constitute a series circuit. The series circuit of the semiconductor switching elements U1 to U4 is connected between the first output point P1 and the second output point P2, of the converter circuit 311. A connecting point between the semiconductor switching elements U1 and U2 is connected to the third output point P3 of the converter circuit 311 through a diode D5. An anode of the diode D5 is connected to the third output point P3 and a cathode of the diode D5 is connected to the connecting point of the semiconductor switching elements U1 and U2. A connecting point between the semiconductor switching elements U2 and U3 constitutes a U-phase output terminal Pu connected to a U-phase input terminal of the electric motor 42. A connecting point between the semiconductor switching elements U3 and U4 is connected to the third output point P3 of the converter circuit 311 through a diode D6. A cathode of the diode D6 is connected to the third output point P3 and an anode of the diode D6 is connected to the connecting point between the semiconductor switching elements U3 and U4.

The semiconductor switching elements V1 to V4 constitute a series circuit. The series circuit of the semiconductor switching elements V1 to V4 is connected between the first output point P1 and the second output point P2, of the converter circuit 311. A connecting point between the semiconductor switching elements V1 and V2 is connected to the third output point P3 of the converter circuit 311 through a diode D7. An anode of the diode D7 is connected to the third output point P3 and a cathode of the diode D7 is connected to the connecting point of the semiconductor switching elements V1 and V2. A connecting point between the semiconductor switching elements V2 and V3 constitutes a V-phase output terminal Pv connected to a V-phase input terminal of the electric motor 42. A connecting point between the semiconductor switching elements V3 and V4 is connected to the third output point P3 of the converter circuit 311 through a diode D8. A cathode of the diode D8 is connected to the third output point P3 and an anode of the diode D8 is connected to the connecting point between the semiconductor switching elements V3 and V4.

The semiconductor switching elements W1 to W4 constitute a series circuit. The series circuit of the semiconductor switching elements W1 to W4 is connected between the first output point P1 and the second output point P2, of the converter circuit 311. A connecting point between the semiconductor switching elements W1 and W2 is connected to the third output point P3 of the converter circuit 311 through a diode D9. An anode of the diode D9 is connected to the third output point P3 and a cathode of the diode D9 is connected to the connecting point of the semiconductor switching elements W1 and W2. A connecting point between the semiconductor switching elements W2 and W3 constitutes a W-phase output terminal Pw connected to a W-phase input terminal of the electric motor 42. A connecting point between the semiconductor switching elements W3 and W4 is connected to the third output point P3 of the converter circuit 311 through a diode D10. A cathode of the diode D10 is connected to the third output point P3 and an anode of the diode D10 is connected to the connecting point between the semiconductor switching elements W3 and W4.

In the inverter circuit 312, the series circuit of the semiconductor switching elements U1 to U4 constitutes a U-phase leg. The series circuit of the semiconductor switching elements V1 to V4 constitutes a V-phase leg. The series circuit of the semiconductor switching elements W1 to W4 constitutes a W-phase leg. In this case, the semiconductor switching elements U1 to U4, V1 to V4, W1 to W4 are also referred to as arms.

In the inverter circuit 312 of FIG. 2, the semiconductor switching elements U1, U2, V1, V2, W1 and W2 constitute a first semiconductor switching element group connected between the first output point P1 and the electric motor 42. In particular, the semiconductor switching elements U1 and U2 constitute a U-phase first semiconductor switching element group connected between the first output point P1 and the U-phase input terminal of the electric motor 42. The semiconductor switching elements V1 and V2 constitute a V-phase first semiconductor switching element group connected between the first output point P1 and the V-phase input terminal of the electric motor 42. The semiconductor switching elements W1 and W2 constitute a W-phase first semiconductor switching element group connected between the first output point P1 and the W-phase input terminal of the electric motor 42.

In the inverter circuit 312 of FIG. 2, the semiconductor switching elements U3, U4, V3, V4, W3 and W4 constitute a second semiconductor switching element group connected between the second output point P2 and the electric motor 42. In particular, the semiconductor switching elements U3 and U4 constitute a U-phase second semiconductor switching element group connected between the second output point P2 and the U-phase input terminal of the electric motor 42. The semiconductor switching elements V3 and V4 constitute a V-phase second semiconductor switching element group connected between the second output point P2 and the V-phase input terminal of the electric motor 42. The semiconductor switching elements W3 and W4 constitute a W-phase second semiconductor switching element group connected between the second output point P2 and the W-phase input terminal of the electric motor 42.

In the inverter circuit 312 of FIG. 2, the semiconductor switching elements U2, U3, V2, V3, W2 and W3 constitute a third semiconductor switching element group connected between the third output point P3 and the electric motor 42. In particular, the semiconductor switching elements U2 and U3 constitute a U-phase third semiconductor switching element group connected between the third output point P3 and the U-phase input terminal of the electric motor 42. The semiconductor switching elements V2 and V3 constitute a V-phase third semiconductor switching element group connected between the third output point P3 and the V-phase input terminal of the electric motor 42. The semiconductor switching elements W2 and W3 constitute a W-phase third semiconductor switching element group connected between the third output point P3 and the W-phase input terminal of the electric motor 42.

In the drive circuit 31 of FIG. 2, the converter circuit 311 includes a plurality of output points including the first output point P1 for outputting the first voltage, the second output point P2 for outputting the second voltage lower than the first voltage, and the third output point P3 for outputting the third voltage between the first voltage and the second voltage. The inverter circuit 312 includes a plurality of semiconductor switching element groups including the first semiconductor switching element group (the semiconductor switching elements U1, U2, V1, V2, W1 and W2) connected between the first output point P1 and the electric motor 42, the second semiconductor switching element group (the semiconductor switching elements U3, U4, V3, V4, W3 and W4) connected between the second output point P2 and the electric motor 42, and the third semiconductor switching element group (the semiconductor switching elements U2, U3, V2, V3, W2 and W3) connected between the third output point P3 and the electric motor 42. The drive circuit 31 of FIG. 2 is a so-called multi-level inverter, especially, a three-level inverter.

The control circuit 32 may be realized by a computer system including, at least, one or more processors (microprocessors) and one or more memories, for example. The control circuit 32 is configured to control the drive circuit 31. Especially, the control circuit 32 is configured to perform PWM control on the plurality of semiconductor switching element groups of the inverter circuit 312 of the drive circuit 31 to allow the drive circuit 31 to operate the electric motor 42. In detail, the control circuit 32 is configured to control switching of the plurality of semiconductor switching elements U1 to U4, V1 to V4 and W1 to W4 of the inverter circuit 312 of the drive circuit 31 to allow the inverter circuit 312 to supply three-phase alternating current power to the electric motor 42 based on the direct current power from the smoothing circuit 311*b*.

Figure 4:
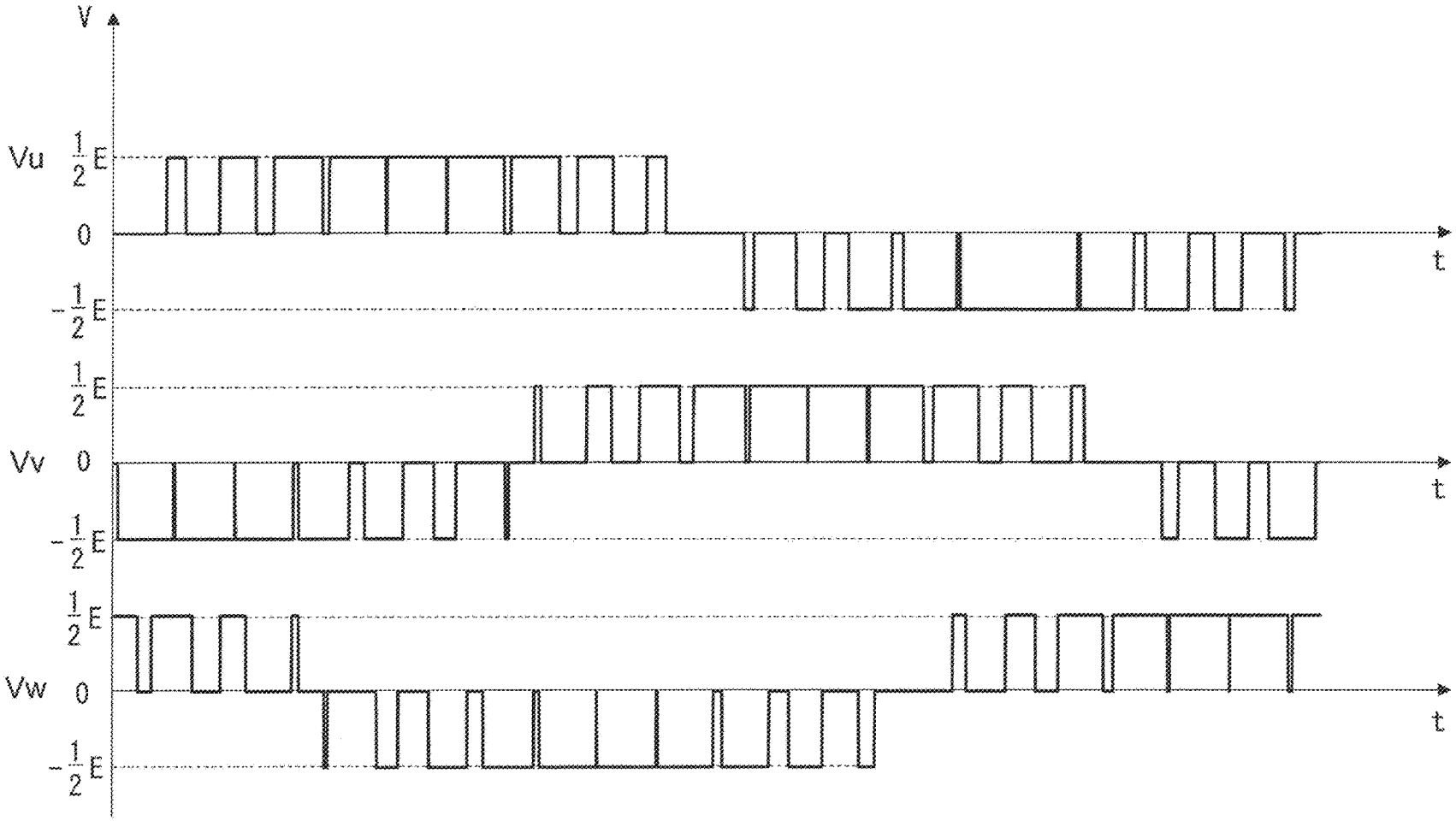
FIG. 4 is a waveform chart of one example of control operation of the drive circuit by the control circuit of the control device of FIG. 2.
Figure 5:
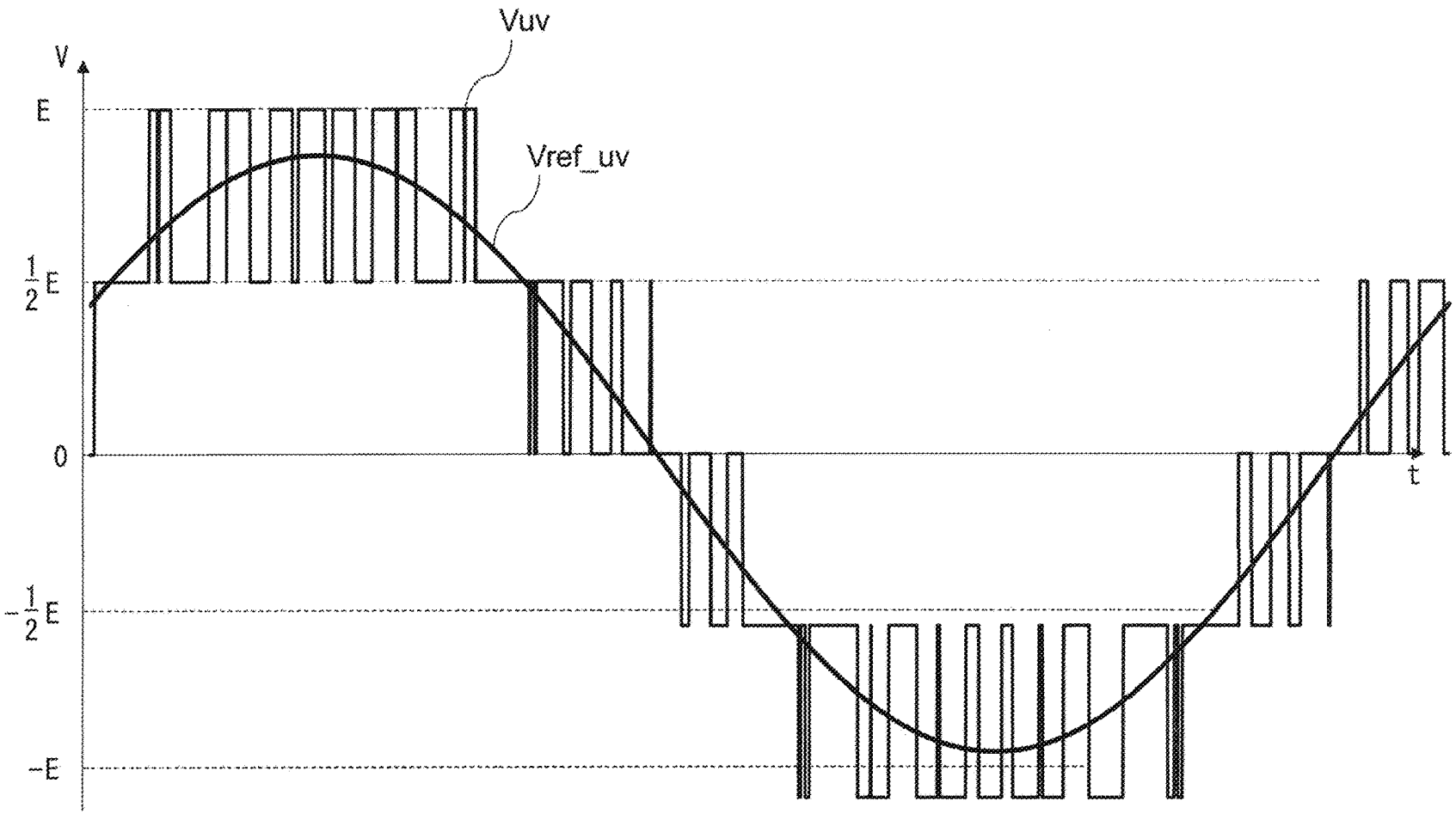
FIG. 5 is a waveform chart of one example of control operation of the drive circuit by the control circuit of the control device of FIG. 2.

FIG. 3 to FIG. 5 are waveform charts of one example of control operation of the drive circuit 31 by the control circuit 32 of the control device 3.

FIG. 3 shows respective waveforms of a U-phase output voltage instruction value Vref_u, a V-phase output voltage instruction value Vref_v, a W-phase output voltage instruction value Vref_w, and, first and second carrier triangle waves Vth1 and Vth2. The U-phase output voltage instruction value Vref_u, the V-phase output voltage instruction value Vref_v and the W-phase output voltage instruction value Vref_w correspond to U-phase, V-phase and W-phase sinusoidal alternating current voltages of a three-phase alternating current. A value of the first carrier triangle wave Vth1 is equal to or greater than 0 and a value of the second carrier triangle wave Vth2 is equal to or smaller than 0.

The control circuit 32 controls switching of the semiconductor switching elements U1 to U4, V1 to V4, and W1 to W4 based on the U-phase output voltage instruction value Vref_u, the V-phase output voltage instruction value Vref_v, the W-phase output voltage instruction value Vref_w as well as the first and second carrier triangle waves Vth1 and Vth2.

FIG. 4 shows respective waveforms of a U-phase output voltage Vu, a V-phase output voltage Vv and a W-phase output voltage Vw. The U-phase output voltage Vu is a voltage of the U-phase output terminal Pu. The V-phase output voltage Vv is a voltage of the V-phase output terminal Pv. The W-phase output voltage Vw is a voltage of the W-phase output terminal Pw. In FIG. 4, the U-phase output voltage Vu, the V-phase output voltage Vy and the W-phase output voltage Vw are shown as a potential difference between the first voltage and the second voltage is E and the third voltage is 0.

When the U-phase output voltage instruction value Vref_u is greater or larger than the first carrier triangle wave Vth1, the control circuit 32 turns on the U-phase first semiconductor switching element group (the semiconductor switching elements U1 and U2) (the first state). When the U-phase output voltage instruction value Vref_u is equal to or smaller than the first carrier triangle wave Vth1 and is equal to or greater than the second carrier triangle wave Vth2, the control circuit 32 turns on the U-phase third semiconductor switching element group (the semiconductor switching elements U2 and U3) (the third state). When the U-phase output voltage instruction value Vref_u is smaller than the second carrier triangle wave Vth2, the control circuit 32 turns on the U-phase second semiconductor switching element group (the semiconductor switching elements U3 and U4) (the second state). By doing so, the control circuit 32 allows the U-phase output voltage Vu of FIG. 4 to output from the U-phase output terminal Pu of the drive circuit 31 to the U-shape input terminal of the electric motor 42. The following TABLE 1 shows a conclusion of conditions for on/off-states of the semiconductor switching elements U1 to U4. In the following TABLE 1, for the semiconductor switching elements U1 to U4, "1" indicates the on-state and "0" indicates the off-state.

TABLE

| State | Condition | U1 | U2 | U3 | U4 | Vu |
|---|---|---|---|---|---|---|
| First State | Vref_u > Vth1 | 1 | 1 | 0 | 0 | E/2 |
| Third State | Vth ≥ Vref_u ≥ Vth2 | 0 | 1 | 1 | 0 | 0 |
| Second State | Vth2 > Vref_u | 0 | 0 | 1 | 1 | −E/2 |

When the V-phase output voltage instruction value Vref_v is greater or larger than the first carrier triangle wave Vth1, the control circuit 32 turns on the V-phase first semiconductor switching element group (the semiconductor switching elements V1 and V2) (the first state). When the V-phase output voltage instruction value Vref_v is equal to or smaller than the first carrier triangle wave Vth1 and is equal to or greater than the second carrier triangle wave Vth2, the control circuit 32 turns on the V-phase third semiconductor switching element group (the semiconductor switching elements V2 and V3) (the third state). When the V-phase output voltage instruction value Vref_v is smaller than the second carrier triangle wave Vth2, the control circuit 32 turns on the V-phase second semiconductor switching element group (the semiconductor switching elements V3 and V4) (the second state). By doing so, the control circuit 32 allows the V-phase output voltage Vv of FIG. 4 to output from the V-phase output terminal Pv of the drive circuit 31 to the V-shape input terminal of the electric motor 42. The following TABLE 2 shows a conclusion of conditions for on/off-states of the semiconductor switching elements V1 to V4. In the following TABLE 2, for the semiconductor switching elements V1 to V4, "1" indicates the-state and "0" indicates the off-state.

TABLE 2

| State | Condition | V1 | V2 | V3 | V4 | Vv |
|---|---|---|---|---|---|---|
| First State | Vref_v > Vth1 | 1 | 1 | 0 | 0 | E/2 |
| Third State | Vth ≥ Vref_v ≥ Vth2 | 0 | 1 | 1 | 0 | 0 |
| Second State | Vth2 > Vref_v | 0 | 0 | 1 | 1 | −E/2 |

When the W-phase output voltage instruction value Vref_w is greater or larger than the first carrier triangle wave Vth1, the control circuit 32 turns on the W-phase first semiconductor switching element group (the semiconductor switching elements W1 and W2) (the first state). When the W-phase output voltage instruction value Vref_w is equal to or smaller than the first carrier triangle wave Vth1 and is equal to or greater than the second carrier triangle wave Vth2, the control circuit 32 turns on the W-phase third semiconductor switching element group (the semiconductor switching elements W2 and W3) (the third state). When the W-phase output voltage instruction value Vref_w is smaller than the second carrier triangle wave Vth2, the control circuit 32 turns on the W-phase second semiconductor switching element group (the semiconductor switching elements W3 and W4) (the second state). By doing so, the control circuit 32 allows the W-phase output voltage Vw of FIG. 4 to output from the W-phase output terminal Pv of the drive circuit 31 to the W-shape input terminal of the electric motor 42. The following TABLE 3 shows a conclusion of conditions for on/off-states of the semiconductor switching elements W1 to W4. In the following TABLE 3, for the semiconductor switching elements W1 to W4, "1" indicates the-state and "0" indicates the off-state.

TABLE 3

| State | Condition | W1 | W2 | W3 | W4 | Vw |
|---|---|---|---|---|---|---|
| First State | Vref_w > Vth1 | 1 | 1 | 0 | 0 | E/2 |
| Third State | Vth ≥ Vref_w ≥ Vth2 | 0 | 1 | 1 | 0 | 0 |
| Second State | Vth2 > Vref_w | 0 | 0 | 1 | 1 | −E/2 |

FIG. 5 shows a waveform of a voltage Vuv between the U-phase input terminal and the V-phase input terminal, of the electric motor 42. The voltage Vuv corresponds to a voltage between the U-phase output terminal Vu and the V-phase output terminal Vv, of the inverter circuit 312 of the drive circuit 31. From FIG. 5, the drive circuit 31 can give five level voltages of E, E/2, 0, −E/2, and −E. In FIG. 5, Vref_uv represents a difference between the U-phase output voltage instruction value Vref_u and the V-phase output voltage instruction value Vref_v. From FIG. 5, it should be understood that a waveform of the voltage Vuv between the U-phase input terminal and the V-phase input terminal, of the electric motor 42 can be made closer to a sinusoidal wave.

As described above, the control circuit 32 performs PWM control on the plurality of semiconductor switching element groups of the inverter circuit 312 of the drive circuit 31 to allow the drive circuit 31 to operate the electric motor 42. In driving the electric motor 42 by the drive circuit 31, switching of the semiconductor switching element U1 to U4, V1 to V4, and W1 to W4 of the inverter circuit 312 of the drive circuit 31 may cause a voltage change. Note that, there are inductances and floating capacitances existing at wires between the drive circuit 31 and the electric motor 42. Therefore, the voltage change caused by switching of the semiconductor switching element U1 to U4, V1 to V4, and W1 to W4 may cause a surge voltage due to an LC resonance. In summary, when the electric motor 42 is driven by the drive circuit 31, switching of the semiconductor switching element U1 to U4, V1 to V4, and W1 to W4 of the inverter circuit 312 of the drive circuit 31 may cause a surge voltage. Such a surge voltage may reach about a double of the voltage change caused by switching of the semiconductor switching element U1 to U4, V1 to V4, and W1 to W4, depending on conditions, such as switching frequencies of the semiconductor switching elements U1 to U4, V1 to V4, and W1 to W4, wiring between the drive circuit 31 and the electric motor 42, and the like.

For example, the surge voltage may cause a discharge phenomenon such as corona discharge between windings. Although corona discharge has a very small energy of only a few picocoulombs per cycle, corona discharge may transition to arc discharge gradually when the switching frequency is high. Thus, it is considered that when the surge voltage is applied to the electric motor 42, insulating covers of the windings may deteriorate, be damaged at the electric motor 42 and finally this may cause dielectric breakdown of the electric motor 42. In particular, in the compressor 4, heat may be caused at the electric motor 42 during driving the electric motor 42. It is necessary to dissipate heat from the electric motor 42. It is very efficient to use the working medium to dissipate heat from the electric motor 42. In view of this, the electric motor 42 is placed inside the sealed container 40 to be allowed to be in contact with the working medium. However, when dielectric breakdown of the electric motor 42 occurs and thus a discharge phenomenon occurs, such a discharge phenomenon may directly influence on the working medium. Especially, a discharge phenomenon is high likely to produce heat and radicals which may cause a disproportionation reaction of the working medium. This means that there is a high probability of progress of a disproportionation reaction of the working medium.

To prevent deterioration of or damages to insulating covers of windings of the electric motor 42 caused by a surge voltage, strengthening insulating properties of the insulating covers of windings of the electric motor 42 is considered. For example, the insulating properties can be strengthened by increasing thicknesses of the insulating covers of windings of the electric motor 42. However, when the insulating covers of windings of the electric motor 42 become thick, a filling factor of windings becomes low and this may cause a decrease in the performance of the electric motor 42. A decrease in the performance of the electric motor 42 may result in a decrease in the operation efficiency of the refrigerator cycle device 1.

In view of the above point, in the drive circuit 31 of the refrigerator cycle device 1 according to the present embodiment, the converter circuit 311 includes a plurality of output points including the first output point P1 for outputting the first voltage, the second output point P2 for outputting the second voltage lower than the first voltage, and the third output point P3 for outputting the third voltage between the first voltage and the second voltage. The inverter circuit 312 includes a plurality of semiconductor switching element groups including the first semiconductor switching element group (the semiconductor switching elements U1, U2, V1, V2, W1, W2) connected between the first output point P1 and the electric motor 42, the second semiconductor switching element group (the semiconductor switching elements U3, U4, V3, V4, W3, W4) connected between the second output point P2 and the electric motor 42, and the third semiconductor switching element group (the semiconductor switching elements U2, U3, V2, V3, W2, W3) connected between the third output point P3 and the electric motor 42.

In the refrigerator cycle device 1 according to the present embodiment, since the converter circuit 311 includes the third output point P3 for outputting the third voltage between the first voltage and the second voltage, voltage changes caused by switching of the semiconductor switching elements, can be reduced from a voltage between the first voltage and the second voltage to a voltage between the first voltage and the third voltage or a voltage between the second voltage and the third voltage. Thus, the refrigerator cycle device 1 according to the present embodiment enables reduction of the voltage changes themself at switching of the semiconductor switching elements U1 to U4, V1 to V4, and W1 to W4, and the surge voltage itself therefore can be suppressed.

Figure 6:
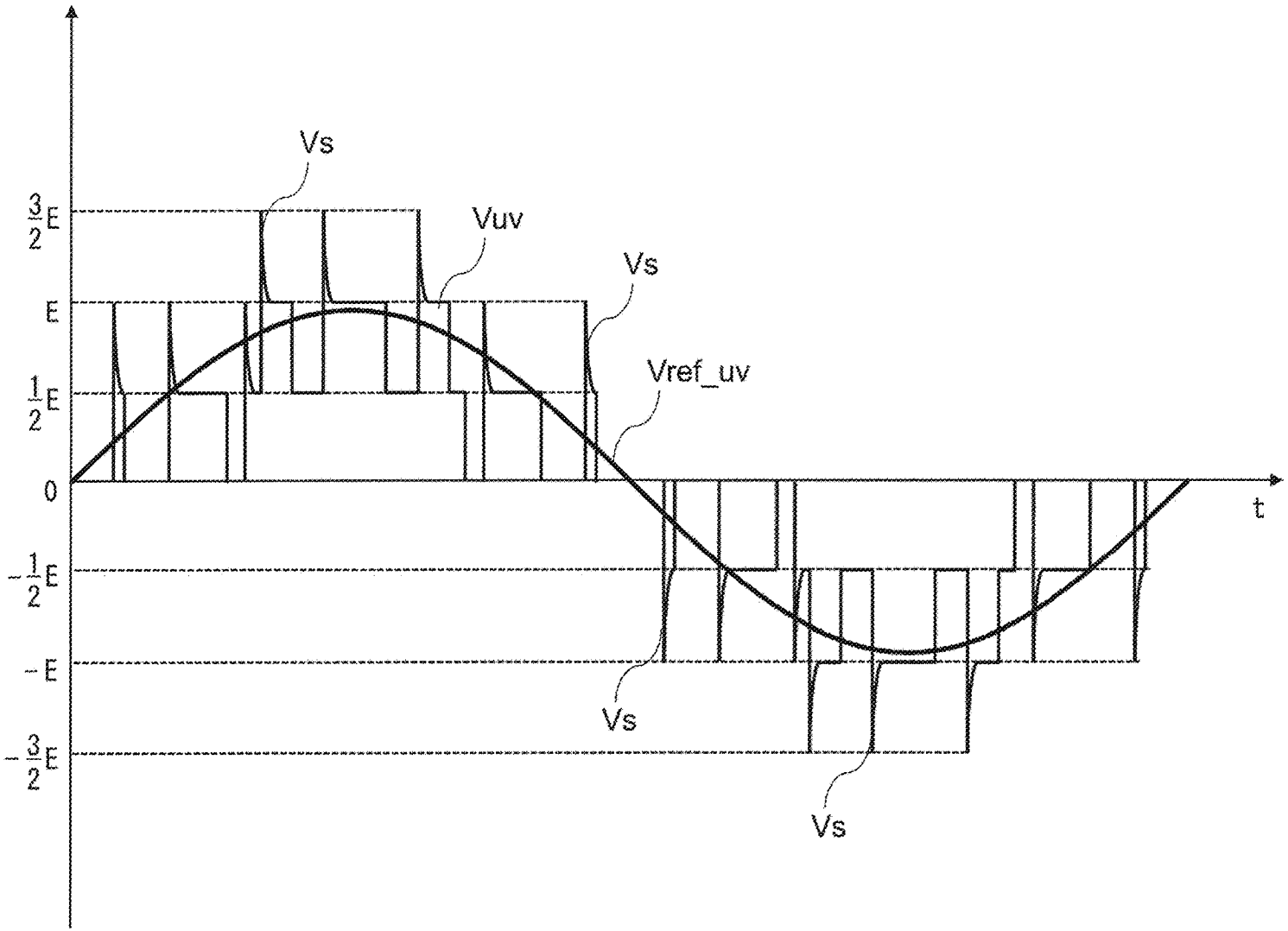
FIG. 6 is a schematic explanatory diagram of a surge voltage at the refrigeration cycle device of FIG. 1.

FIG. 6 is a schematic explanatory diagram of a surge voltage at the refrigeration cycle device 1 according to the present embodiment. In more detail, FIG. 6 shows a waveform of the voltage Vuv between the U-phase input terminal and the V-phase input terminal of the electric motor 42. To prioritize visibility of the drawing, the waveform of the voltage Vuv of FIG. 6 is illustrated as a simplification of the waveform of the voltage Vvu of FIG. 5. Also in FIG. 6, Vref_uv indicates a difference between the U-phase output voltage instruction value Vref_u and the V-phase output voltage instruction value Vref_v. In the present embodiment, the third voltage is a middle voltage between the first voltage and the second voltage. When the voltage between the first voltage and the second voltage is E, a voltage between the first voltage and the third voltage is E/2 and similarly a voltage between the second voltage and the third voltage is E/2. Therefore, a voltage increase caused by the surge voltage Vs at switching is E/2 in each of switching between the first voltage and the third voltage and switching between the second voltage and the third voltage. Accordingly, as shown in FIG. 6, an absolute value of the maximum value of the voltage applied to the electric motor 42 is 3E/2.

Figure 7:
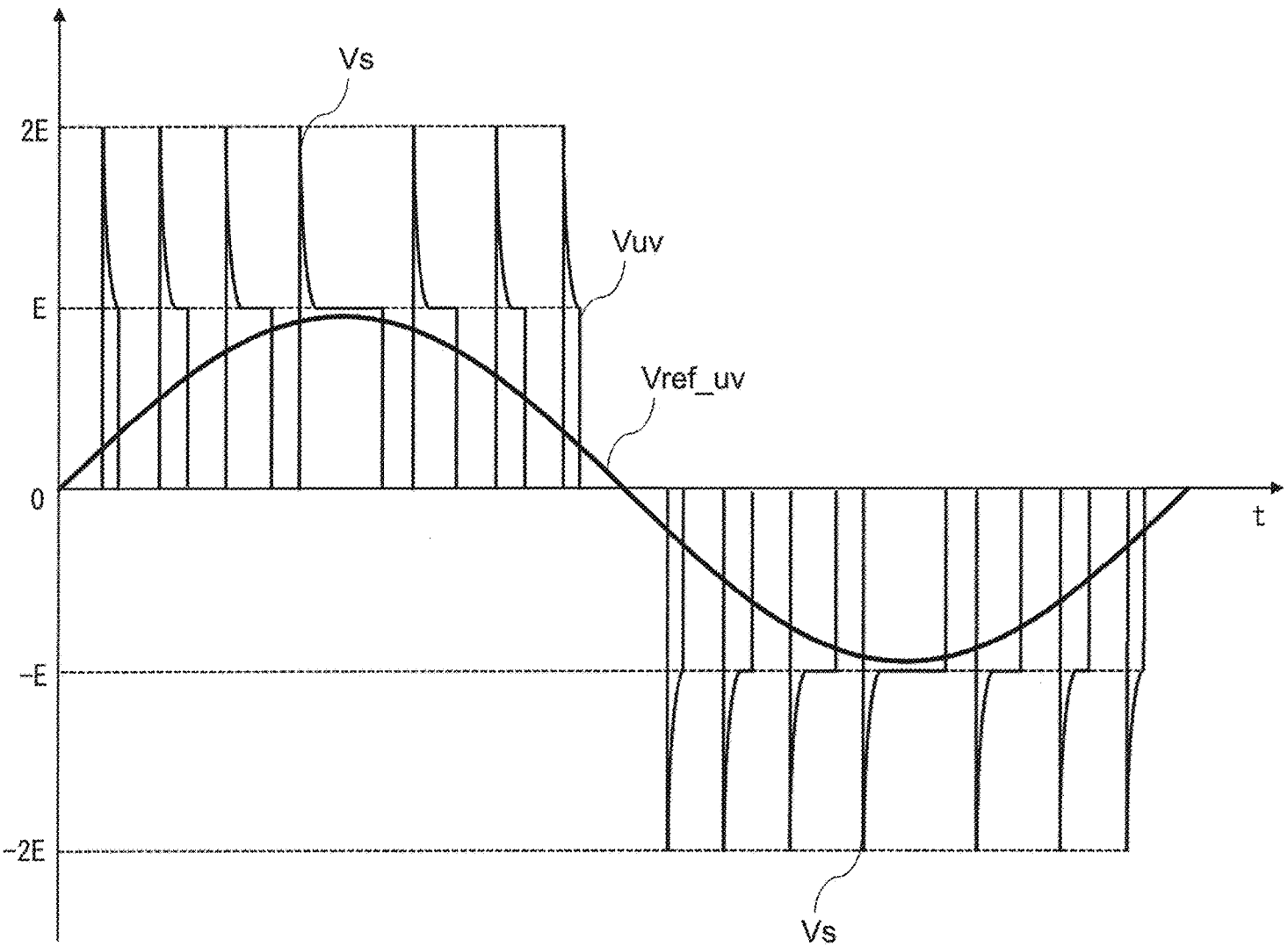
FIG. 7 is a schematic explanatory diagram of a surge voltage at a refrigeration cycle device of a comparative example.

FIG. 7 is a schematic explanatory diagram of a surge voltage at a refrigeration cycle device of a comparative example. The comparative example corresponds to a case where the converter circuit 311 of the drive circuit 31 is devoid of the third output point P3 for outputting the third voltage between the first voltage and the second voltage. In the refrigerator cycle device of FIG. 7, the drive circuit 31 cannot give the five-level voltages of E, E/2, 0, −E/2, and −E but only can give three-level voltages of E, 0, and −E. Therefore, a voltage increase caused by the surge voltage Vs at switching is E. Accordingly, as shown in FIG. 7, an absolute value of the maximum value of the voltage applied to the electric motor 42 is 2E and is larger than that in the case of FIG. 6.

As described above, the refrigerator cycle device 1 according to the present embodiment can reduce voltage changes themself at switching of the semiconductor switching elements U1 to U4, V1 to V4, and W1 to W4, and therefore enables suppression of a surge voltage itself. Such a reduction of the surge voltage itself can lead to a decrease in a probability of deterioration of or damages to the insulating covers of windings of the electric motor 42 due to the surge voltage. Owing to a decrease in the probability of deterioration of or damages to the insulating covers of windings of the electric motor 42, occurrence of a discharge phenomenon can be suppressed. Since the occurrence of the discharge phenomenon is reduced, a disproportionation reaction of the working medium is suppressed. Therefore, the refrigerator cycle device 1 according to the present embodiment enables suppression of a disproportionation reaction of the working medium.

[1.2 Advantageous Effects]

The aforementioned refrigerator cycle device 1 includes: the refrigeration cycle circuit 2 including the compressor 4, the condenser (the first heat exchanger 5, the second heat exchanger 7), the expansion valve 6 and the evaporator the first heat exchanger 5, the second heat exchanger 7 and allowing circulation of the working medium 20; and the control device 3 configured to control the compressor 4 of the refrigeration cycle circuit 2. The working medium 20 contains ethylene-based fluoroolefin as a refrigerant component. The compressor 4 includes the sealed container 40 constituting the fluidic pathway for the working medium 20, the compression mechanism 41 positioned inside the sealed container 40 to compress the working medium 20, and an electric motor 42 positioned inside the sealed container 40 to operate the compression mechanism 41. The control device 3 includes the drive circuit 31 configured to drive the electric motor 42, and the control circuit 32 configured to control the drive circuit 31. The drive circuit 31 includes: the converter circuit 311 including a plurality of output points P1, P2, P3 including the first output point P1 for outputting the first voltage, the second output point P2 for outputting the second voltage lower than the first voltage, and one or more third output points P3 for outputting the third voltage between the first voltage and the second voltage: and the inverter circuit 312 including a plurality of semiconductor switching element groups including the first semiconductor switching element group (the semiconductor switching elements U1, U2, V1, V2, W1, W2) connected between the first output point P1 and the electric motor 42, the second semiconductor switching element group (the semiconductor switching elements U3, U4, V3, V4, W3, W4) connected between the second output point P2 and the electric motor 42, and one or more third semiconductor switching element groups (the semiconductor switching elements U2, U3, V2, V3, W2, W3) individually connected between the one or more third output points P3 and the electric motor 42. The control circuit 32 is configured to perform PWM control on the plurality of semiconductor switching element groups of the inverter circuit 312 of the drive circuit 31 to allow the drive circuit 31 to operate the electric motor 42. This configuration enables suppression of a disproportionation reaction of the working medium.

In the refrigerator cycle device 1, the control circuit 32 is configured to switch between the first state in which the first semiconductor switching element group (the semiconductor switching elements U1, U2, V1, V2, W1, W2) is on to connect the first output point P1 to the electric motor 42 and the second state in which the second semiconductor switching element group (the semiconductor switching elements U3, U4, V3, V4, W3, W4) is on to connect the second output point P2 to the electric motor 42, by way of the third state in which the one or more third semiconductor switching element groups (the semiconductor switching elements U2, U3, V2, V3, W2, W3) are on to connect the one or more third output points P3 to the electric motor 42. This configuration enables improvement of effect of suppression of a disproportionation reaction of the working medium.

In the refrigerator cycle device 1, the ethylene-based fluoroolefin contains ethylene-based fluoroolefin likely to undergo a disproportionation reaction. This configuration enables suppression of a disproportionation reaction of the working medium.

In the refrigerator cycle device 1, the ethylene-based fluoroolefin is 1,1,2-trifluoroethylene, trans-1,2-difluoroethylene, cis-1,2-difluoroethylene, 1,1-difluoroethylene, tetrafluoroethylene, or monofluoroethylene. This configuration enables suppression of a disproportionation reaction of the working medium.

In the refrigerator cycle device 1, the working medium 20 contains difluoromethane as the refrigerant component. This configuration enables suppression of a disproportionation reaction of the working medium.

In the refrigerator cycle device 1, the working medium 20 further contains a saturated hydrocarbon. This configuration enables suppression of a disproportionation reaction of the working medium.

In the refrigerator cycle device 1, the working medium 20 contains a haloalkane with 1 or 2 carbon atoms as a disproportionation inhibitor for suppressing a disproportionation reaction of the ethylene-based fluoroolefin. This configuration enables suppression of a disproportionation reaction of the working medium.

In the refrigerator cycle device 1, the saturated hydrocarbon contains n-propane. This configuration enables suppression of a disproportionation reaction of the working medium.

The aforementioned refrigeration cycle device 1 includes: the refrigeration cycle circuit 2 including the compressor 4, the condenser (the first heat exchanger 5, the second heat exchanger 7), the expansion valve 6 and the evaporator (the first heat exchanger 5, the second heat exchanger 7) and allowing circulation of the working medium 20; and the control device 3 configured to control the compressor 4 of the refrigeration cycle circuit 2. The working medium 20 contains ethylene-based fluoroolefin as a refrigerant component. The compressor 4 includes the sealed container 40 constituting a fluidic pathway for the working medium 20, the compression mechanism 41 positioned inside the sealed container 40 to compress the working medium 20, and the electric motor 42 positioned inside the sealed container 40 to operate the compression mechanism 41. The control device 3 includes the multi-level inverter (the drive circuit 31) configured to drive the electric motor 42, and the control circuit 32 configured to perform PWM control on the multi-level inverter. This configuration enables suppression of a disproportionation reaction of the working medium.

2. Variations

Embodiments of the present disclosure are not limited to the above embodiment. The above embodiment may be modified in various ways in accordance with designs or the like to an extent that they can achieve the problem of the present disclosure. Hereinafter, some variations or modifications of the above embodiment will be listed. One or more of the variations or modifications described below may apply in combination with one or more of the others.

In one variation, the power supply 10 may be one or more of various types of alternating current power supplies, especially, a commercial power supply. The commercial power supplies may have different voltages and frequencies depending on countries or the like, but the drive circuit 31 can be configured to drive the electric motor 42 by use of various types of commercial power supplies.

In one variation, the drive circuit 31 may be configured to supply drive power corresponding to a type of the electric motor 42 or the like. The drive power may not be limited to three-phase alternating current but may be single-phase alternating current.

In one variation, the converter circuit 311 may include a plurality of third output points. The plurality of third output points can output mutually different third voltages. The inverter circuit 312 may include a plurality of third semiconductor switching element groups individually connected between the plurality of third output points and the electric motor 42. When the total number of the first output point P1, the second output point P2 and the plurality of third output points P3 is denoted by n, the drive circuit 31 can give (2×n−1)-level voltages. By increasing n, the voltage waveform applied by the drive circuit 31 to the electric motor 42 can be made to be closer to a sinusoidal wave.

In one variation, a circuit configuration of the inverter circuit 312 is not limited to the circuit configuration of FIG. 2. The circuit configuration of the inverter circuit 312 of FIG. 2 is a so-called NPC (Neutral-Point-Clamped) type but may be an A-NPC (Advanced-NPC) type. The inverter circuit 312 may include a plurality of semiconductor switching element groups individually connected between a plurality of output points with different voltages and the electric motor. A plurality of semiconductor switching elements constituting a plurality of semiconductor switching element groups may include one or more semiconductor switching elements commonly included in two or more semiconductor switching element groups.

In one variation, the refrigeration cycle device is not limited to an air conditioner with a configuration where one indoor unit is connected to one outdoor unit (so called, a room air conditioner (RAC)). The refrigeration cycle device may be an air conditioner with a configuration where a plurality of indoor units are connected to one or more outdoor units (so-called, a package air conditioner (PAC) or a variable refrigerant flow (VRF)). Or, the refrigeration cycle device is not limited to an air conditioner, but may be a freezing or refrigerating device such as a refrigerator or a freezer.

3. Aspects

As apparent from the above embodiment and variations, the present disclosure includes the following aspects. Hereinafter, reference signs in parenthesis are attached for the purpose of clearly showing correspondence with the embodiments only. Note that, in consideration of readability of texts, the reference signs in parentheses may be omitted from the second and subsequent times.

A first aspect is a refrigeration cycle device (1) and includes: a refrigeration cycle circuit (2) including a compressor (4), a condenser (the first heat exchanger 5, the second heat exchanger 7), an expansion valve (6) and an evaporator (the first heat exchanger 5, the second heat exchanger 7), and allowing circulation of a working medium (20); and a control device (3) configured to control the compressor (4) of the refrigeration cycle circuit (2). The working medium (20) contains ethylene-based fluoroolefin as a refrigerant component. The compressor (4) includes a sealed container (40) constituting a fluidic pathway for the working medium (20), a compression mechanism (41) positioned inside the sealed container (40) to compress the working medium (20), and an electric motor (42) positioned inside the sealed container (40) to operate the compression mechanism (41). The control device (3) includes a drive circuit (31) configured to drive the electric motor (42), and a control circuit (32) configured to control the drive circuit (31). The drive circuit (31) includes: a converter circuit (311) including a plurality of output points including a first output point (P1) for outputting a first voltage, a second output point (P2) for outputting a second voltage lower than the first voltage, and one or more third output points (P3) for outputting a third voltage between the first voltage and the second voltage: and an inverter circuit (312) including a plurality of semiconductor switching element groups including a first semiconductor switching element group (the semiconductor switching elements U1, U2, V1, V2, W1, W2) connected between the first output point (P1) and the electric motor (42), a second semiconductor switching element group (the semiconductor switching elements U3, U4, V3, V4, W3, W4) connected between the second output point (P2) and the electric motor (42), and one or more third semiconductor switching element groups (the semiconductor switching elements U2, U3, V2, V3, W2, W3) individually connected between the one or more third output points (P3) and the electric motor (42). The control circuit (32) is configured to perform PWM control on the plurality of semiconductor switching element groups of the inverter circuit (312) of the drive circuit (31) to allow the drive circuit (31) to operate the electric motor (42). This aspect enables suppression of a disproportionation reaction of the working medium.

A second aspect is a refrigeration cycle device (1) based on the first aspect. In the second aspect, the control circuit (32) is configured to switch between a first state in which the first semiconductor switching element group (the semiconductor switching elements U1, U2, V1, V2, W1, W2) is on to connect the first output point (P1) to the electric motor (42) and a second state in which the second semiconductor switching element group (the semiconductor switching elements U3, U4, V3, V4, W3, W4) is on to connect the second output point (P2) to the electric motor (42), by way of a third state in which the one or more third semiconductor switching element groups (the semiconductor switching elements U2, U3, V2, V3, W2, W3) are on to connect the one or more third output points (P3) to the electric motor (42). This aspect enables improvement of operation efficiency of the refrigeration cycle device (1) and suppression of a disproportionation reaction of the working medium.

A third aspect is a refrigeration cycle device (1) based on the first or second aspect. In the third aspect, the ethylene-based fluoroolefin contains ethylene-based fluoroolefin likely to undergo a disproportionation reaction. This aspect enables suppression of a disproportionation reaction of the working medium.

A fourth aspect is a refrigeration cycle device (1) based on any one of the first to third aspects. In the fourth aspect, the ethylene-based fluoroolefin is 1,1,2-trifluoroethylene, trans-1,2-difluoroethylene, cis-1,2-difluoroethylene, 1,1-difluoroethylene, tetrafluoroethylene, or monofluoroethylene. This aspect enables suppression of a disproportionation reaction of the working medium.

A fifth aspect is a refrigeration cycle device (1) based on any one of the first to fourth aspects. In the fifth aspect, the working medium (20) contains difluoromethane as the refrigerant component. This aspect enables suppression of a disproportionation reaction of the working medium.

A sixth aspect is a refrigeration cycle device (1) based on any one of the first to fifth aspects. In the sixth aspect, the working medium (20) further contains a saturated hydrocarbon. This aspect enables suppression of a disproportionation reaction of the working medium.

A seventh aspect is a refrigeration cycle device (1) based on any one of the first to sixth aspects. In the seventh aspect, the working medium contains a haloalkane with 1 or 2 carbon atoms as a disproportionation inhibitor for suppressing a disproportionation reaction of the ethylene-based fluoroolefin. This aspect enables suppression of a disproportionation reaction of the working medium.

An eighth aspect is a refrigeration cycle device (1) based on the sixth aspect. In the eighth aspect, the saturated hydrocarbon contains n-propane. This aspect enables suppression of a disproportionation reaction of the working medium.

A ninth aspect is a refrigeration cycle device (1) and includes: a refrigeration cycle circuit (2) including a compressor (4), a condenser (the first heat exchanger 5, the second heat exchanger 7), an expansion valve (6) and an evaporator (the first heat exchanger 5, the second heat exchanger 7), and allowing circulation of a working medium (20): and a control device (3) configured to control the compressor (4) of the refrigeration cycle circuit (2). The working medium (20) contains ethylene-based fluoroolefin as a refrigerant component. The compressor (4) includes a sealed container (40) constituting a fluidic pathway for the working medium (20), a compression mechanism (41) positioned inside the sealed container (40) to compress the working medium (20), and an electric motor (42) positioned inside the sealed container (40) to operate the compression mechanism (41). The control device (3) includes a multi-level inverter (the drive circuit 31) configured to drive the electric motor (42), and a control circuit (32) configured to perform PWM control on the multi-level inverter. This aspect enables suppression of a disproportionation reaction of the working medium.

The second to eighth aspects are applicable to the ninth aspect with appropriate modification if necessary. The second to eighth aspects are optional and not essential.

INDUSTRIAL APPLICABILITY

The present disclosure is applicable to refrigerator cycle devices. In particular, the present disclosure is applicable to a refrigerator cycle device using a working medium containing ethylene-based fluoroolefin as a refrigerant component.

REFERENCE SIGNS LIST

1 Refrigeration Cycle Device
2 Refrigeration Cycle Circuit
20 Working Medium
3 Control Device
31 Drive Circuit
311 Converter Circuit
P1 First Output Point
P2 Second Output Point
P3 Third Output Point
312 Inverter Circuit
U1, U2, U3, U4 Semiconductor Switching Element
V1, V2, V3, V4 Semiconductor Switching Element
W1, W2, W3, W4 Semiconductor Switching Element
32 Control Circuit
4 Compressor
40 Sealed Container
41 Compression Mechanism
42 Electric Motor
5 First Heat Exchanger (Condenser, Evaporator)
6 Expansion Valve
7 Second Heat Exchanger (Condenser, Evaporator)

The invention claimed is:

1. A refrigeration cycle device comprising:

a refrigeration cycle circuit including a compressor, a condenser, an expansion valve and an evaporator, and allowing circulation of a working medium; and a control device configured to control the compressor of the refrigeration cycle circuit, the working medium containing ethylene-based fluoroolefin as a refrigerant component, the compressor including a sealed container constituting a fluidic pathway for the working medium, a compression mechanism positioned inside the sealed container to compress the working medium, and an electric motor positioned inside the sealed container to operate the compression mechanism, the control device including a drive circuit configured to drive the electric motor, and a control circuit configured to control the drive circuit, the drive circuit including a converter circuit including a plurality of output points including a first output point for outputting a first voltage, a second output point for outputting a second voltage lower than the first voltage, and one or more third output points for outputting a third voltage between the first voltage and the second voltage, and an inverter circuit including a plurality of semiconductor switching element groups including a first semiconductor switching element group connected between the first output point and the electric motor, a second semiconductor switching element group connected between the second output point and the electric motor, and one or more third semiconductor switching element groups individually connected between the one or more third output points and the electric motor, the converter circuit being disposed between a power supply and the inverter circuit, the inverter circuit being disposed between the converter circuit and the electric motor, the converter circuit being configured to convert a first alternating current power to a direct current power, and the inverter circuit being configured to supply a second alternating current power to the electric motor based on the direct current power, and the control circuit being configured to perform PWM control on the plurality of semiconductor switching element groups of the inverter circuit of the drive circuit to allow the drive circuit to operate the electric motor.

2. The refrigeration cycle device according to claim 1, wherein the control circuit is configured to switch between a first state in which the first semiconductor switching element group is on to connect the first output point to the electric motor and a second state in which the second semiconductor switching element group is on to connect the second output point to the electric motor, by way of a third state in which the one or more third semiconductor switching element groups are on to connect the one or more third output points to the electric motor.

3. The refrigeration cycle device according to claim 1, wherein the ethylene-based fluoroolefin contains ethylene-based fluoroolefin likely to undergo a disproportionation reaction.

4. The refrigeration cycle device according to claim 1, wherein the ethylene-based fluoroolefin is 1,1,2-trifluoroethylene, trans-1,2-difluoroethylene, cis-1,2-difluoroethylene, 1,1-difluoroethylene, tetrafluoroethylene, or monofluoroethylene.

5. The refrigeration cycle device according to claim 1, wherein the working medium contains difluoromethane as the refrigerant component.

6. The refrigeration cycle device according to claim 1, wherein the working medium further contains a saturated hydrocarbon.

7. The refrigeration cycle device according to claim 6, wherein the saturated hydrocarbon contains n-propane.

8. The refrigeration cycle device according to claim 1, wherein the working medium contains a haloalkane with 1 or 2 carbon atoms as a disproportionation inhibitor for suppressing a disproportionation reaction of the ethylene-based fluoroolefin.

9. The refrigeration cycle device according to claim 1, wherein the inverter circuit includes a first set of switching elements constituting a first series circuit connected between the first output point and the second output point.

10. The refrigeration cycle device according to claim 9, wherein in a first state, the control circuit is configured to turn on a first group of the first set of switching elements, in a second state, the control circuit is configured to turn on a second group of the first set of switching elements, and in a third state, the control circuit is configured to turn on a third group of the first set of switching elements.

11. The refrigeration cycle device according to claim 10, wherein the inverter circuit further includes a second set of switching elements constituting a second series circuit connected between the first output point and the second output point.

12. The refrigeration cycle device according to claim 11, wherein in the first state, the control circuit is configured to turn on a first group of the second set of switching elements, in the second state, the control circuit is configured to turn on a second group of the second set of switching elements, and in the third state, the control circuit is configured to turn on a third group of the second set of switching elements.

13. The refrigeration cycle device according to claim 1, wherein the converter circuit includes a rectification circuit and a smoothing circuit.

14. A refrigeration cycle device comprising:

a refrigeration cycle circuit including a compressor, a condenser, an expansion valve and an evaporator, and allowing circulation of a working medium; and a control device configured to control the compressor of the refrigeration cycle circuit, the working medium containing ethylene-based fluoroolefin as a refrigerant component, the compressor including a sealed container constituting a fluidic pathway for the working medium, a compression mechanism positioned inside the sealed container to compress the working medium, and an electric motor positioned inside the sealed container to operate the compression mechanism, the control device including a multi-level inverter configured to drive the electric motor, and a control circuit configured to perform PWM control on the multi-level inverter, wherein the multi-level inverter includes multiple output points for outputting multiple voltages, the multiple voltages are different from each other, the multi-level inverter further includes an electrical component connected between the multiple output points and corresponding input terminals of the electric motor, wherein the multi-level inverter includes a first set of switching elements constituting a first series circuit connected between a first output point and a second output point of the multiple output points, wherein in a first state, the control circuit is configured to turn on a first group of the first set of switching elements, in a second state, the control circuit is configured to turn on a second group of the first set of switching elements, and in a third state, the control circuit is configured to turn on a third group of the first set of switching elements.

15. The refrigeration cycle device according to claim 14, wherein the multi-level inverter further includes a second set of switching elements constituting a second series circuit connected between the first output point and the second output point of the multiple output points.

16. The refrigeration cycle device according to claim 15, wherein in the first state, the control circuit is configured to turn on a first group of the second set of switching elements, in the second state, the control circuit is configured to turn on a second group of the second set of switching elements, and in the third state, the control circuit is configured to turn on a third group of the second set of switching elements.

* * * * *